US005615847A

United States Patent [19]

Bourlett

[11] Patent Number: 5,615,847

[45] Date of Patent: Apr. 1, 1997

[54] SUBMARINE LAUNCHED UNMANNED AERIAL VEHICLE

[75] Inventor: Steven P. Bourlett, Tiverton, R.I.

[73] Assignee: The United States of America as represented by the Secretary of the Navy, Washington, D.C.

[21] Appl. No.: 528,627

[22] Filed: Sep. 11, 1995

[51] Int. Cl.[6] ..... F41F 3/04; F42B 15/20; F42B 10/14; B63G 8/30

[52] U.S. Cl. ..... 244/63; 244/3.25; 244/3.28; 244/3.24; 114/316; 89/1.8; 89/1.809

[58] Field of Search ..... 244/3.1, 3.21, 244/3.22, 3.24, 3.25, 3.27, 3.28, 3.29, 3.3, 63, 72, 190; 114/20.1, 20.2, 21.2, 316; 89/1.8, 1.809, 1.81

[56] References Cited

U.S. PATENT DOCUMENTS

| | | | |
|---|---|---|---|
| 2,821,924 | 2/1958 | Hansen et al. | 244/3.28 |
| 2,922,600 | 1/1960 | Craft | 244/3.21 |
| 2,945,442 | 7/1960 | Adelman et al. | 244/3.28 |
| 3,188,958 | 6/1965 | Burke et al. | 244/3.29 |
| 4,296,894 | 10/1981 | Schnabale et al. | 244/3.27 |
| 4,601,442 | 7/1986 | Friedel et al. | 244/3.24 |
| 4,708,304 | 11/1987 | Wedertz et al. | 244/3.28 |
| 4,944,226 | 7/1990 | Wedertz | 244/3.1 |
| 4,966,078 | 10/1990 | Schleimann-Jensen | 244/3.21 |
| 5,379,968 | 1/1995 | Grosso | 244/3.21 |

*Primary Examiner*—Andres Kashnikow
*Assistant Examiner*—Virna Lissi Mojica
*Attorney, Agent, or Firm*—Michael J. McGowan; James M. Kasischke; Prithvi C. Lall

[57] ABSTRACT

A submarine launched unmanned aerial vehicle comprises an elongated generally cylindrically-shaped body. Tail fins are stored in the body and are self-deployable to extend outwardly from the body. A booster motor is fixed to an aft end of the body and is self-releasable from the body. A propeller is disposed at the aft end of the body and is self-deployable to an exposed position at the aft end of the body after release of the booster motor. A propulsion motor is mounted in the body and is operative to drive the propeller. Rotors are stored in the body and are self-deployable to an exposed position wherein the rotors provide lift to the vehicle.

12 Claims, 5 Drawing Sheets

SUBMARINE LAUNCHED UNMANNED AERIAL VEHICLE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

This invention relates to aerial vehicles launched and controlled by submarines, and is directed more particularly to an aerial vehicle having relatively slow speed and extended endurance, for aerial reconnaissance.

(2) Description of the Prior Art

Unmanned aerial vehicles (UAV's), launched from submarines, are known in the art. Such vehicles include missiles known by names such as Tomahawk, Harpoon, Sealance, Regulus and Subroc. Such missiles are not well suited for intelligence gathering because of their high speed and short time in the air.

Accordingly, there is a need for a UAV which can be launched from, and controlled, by a submarine, and which has a relatively slow speed (less than 150 knots) and the ability to stay in the air for over four hours, thus providing an intelligence gathering platform.

SUMMARY OF THE INVENTION

An object of the invention is, therefore, to provide a UAV, adapted for launch from and control by a submerged submarine, and which is further adapted to remain in the air for four hours or more and to fly at a speed of less than 150 knots.

With the above and other objects in view, as will hereinafter appear, a feature of the present invention is the provision of a submarine launched unmanned aerial vehicle, the vehicle comprising an elongated generally cylindrically-shaped body, tail fins stored in the body and self-deployable to extend outwardly from the body, and a booster motor fixed to an aft end of the body and self-releasable from the body. The vehicle further comprises a propeller stored in the aft end of the body and self-deployable to an exposed position at the aft end of the body, and a propulsion motor mounted in the body and operative to drive the propeller. Rotor means are stored in the body and are self-deployable to an exposed position wherein the rotor means provide lift to the vehicle.

The above and other features of the invention, including various novel details of construction and combinations of parts, will now be more particularly described with reference to the accompanying drawings and pointed out in the claims. It will be understood that the particular vehicle embodying the invention is shown by way of illustration only and not as a limitation of invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF PREFERRED EMBODIMENT

Figure 1:
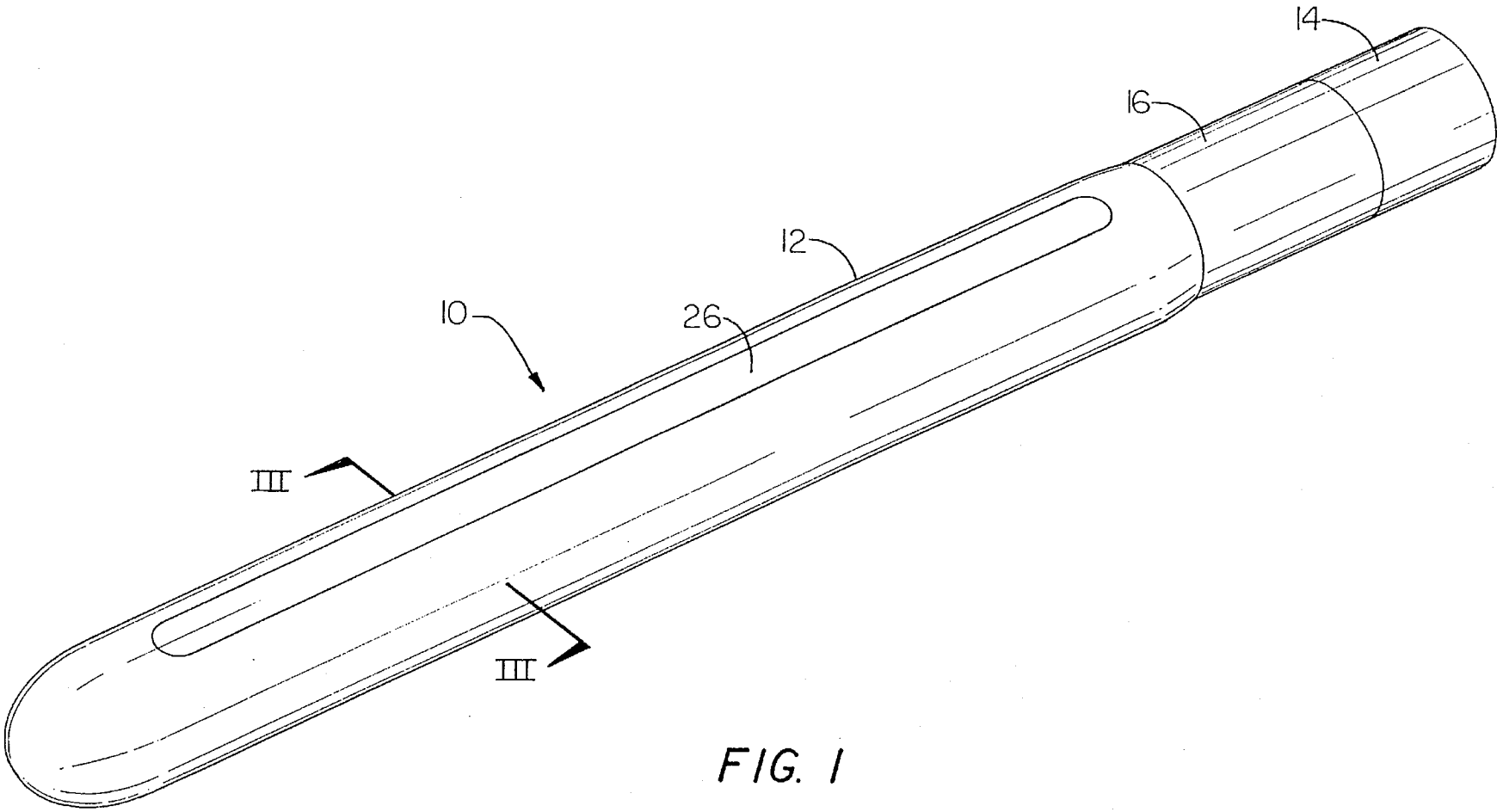
FIG. 1 is a side perspective view of a UAV, illustrative of an embodiment of the invention.

Referring to FIG. 1, it will be seen that an illustrative vehicle 10 includes an elongated, generally cylindrically-shaped body 12, configured in the illustrative embodiment much like a torpedo. The vehicle 10 has fixed thereto, at an aft end thereof, a booster motor 14, preferably a solid fuel rocket motor. Mounted on the vehicle 10 near the booster motor 14 and forwardly thereof is a shroud 16.

Figure 2:
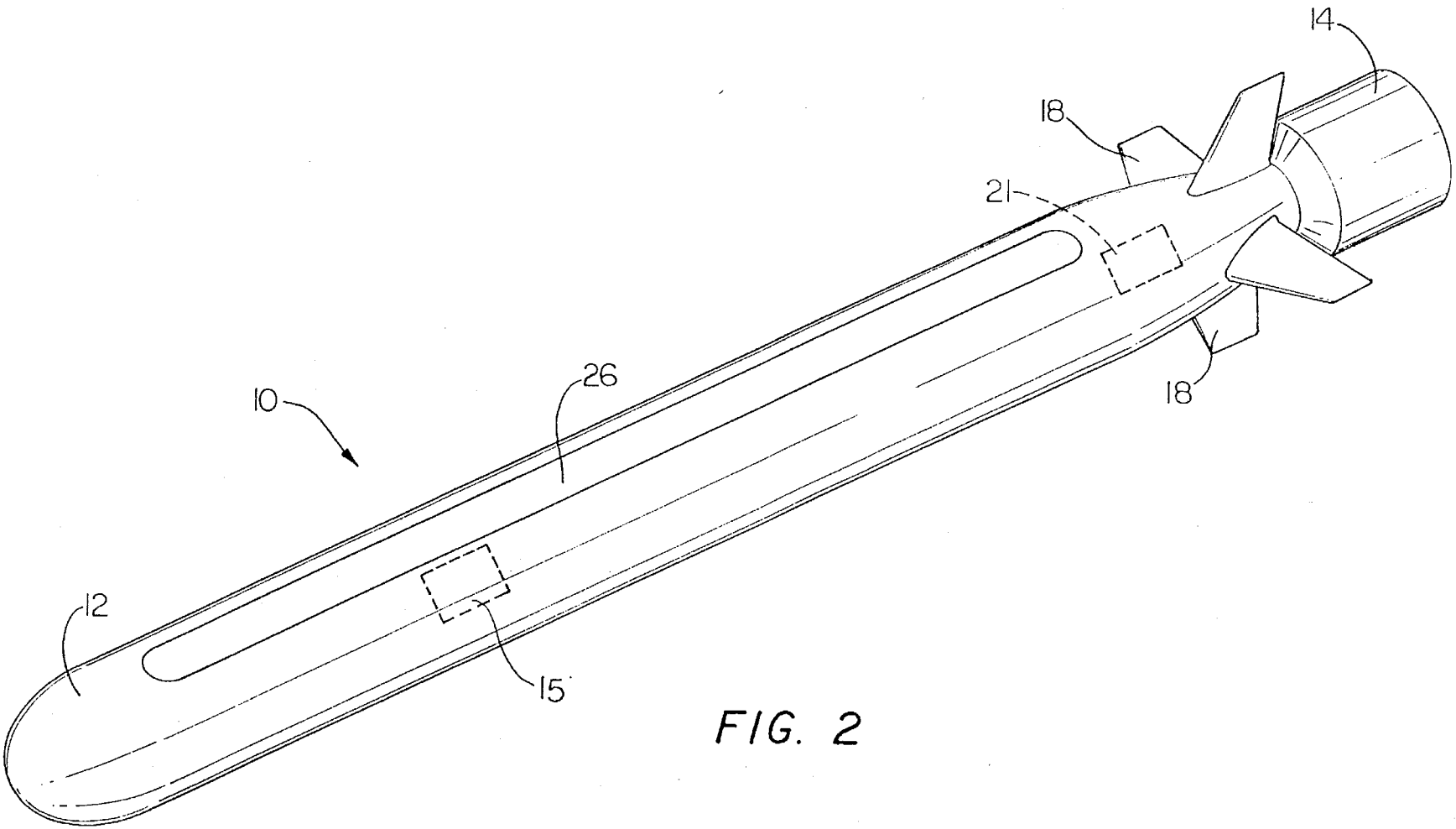
FIG. 2 is similar to FIG. 1, but shows the UAV with a shroud portion removed.

Referring now to FIG. 2, control circuitry 15 is located within body 12 and joined to the various components of the vehicle 10 to coordinate launch, rotor deployment, and propeller deployment. The control circuitry can also be joined to tail fins 18 to steer vehicle 10 and a payload (not shown) to control instruments therein.

Stored within recesses near the aft end of the body 12 are tail fins 18 (FIG. 2) which are biased radially outwardly, but are retained within the recesses by the shroud 16. Upon removal of the shroud, the tail fins 18 deploy radially outwardly, as shown in FIG. 2, to provide stabilization and guidance to the vehicle 10 in flight. Accordingly, each tail fin 18 is joined to a rotational actuator (not shown) within vehicle body 12.

Figure 4:
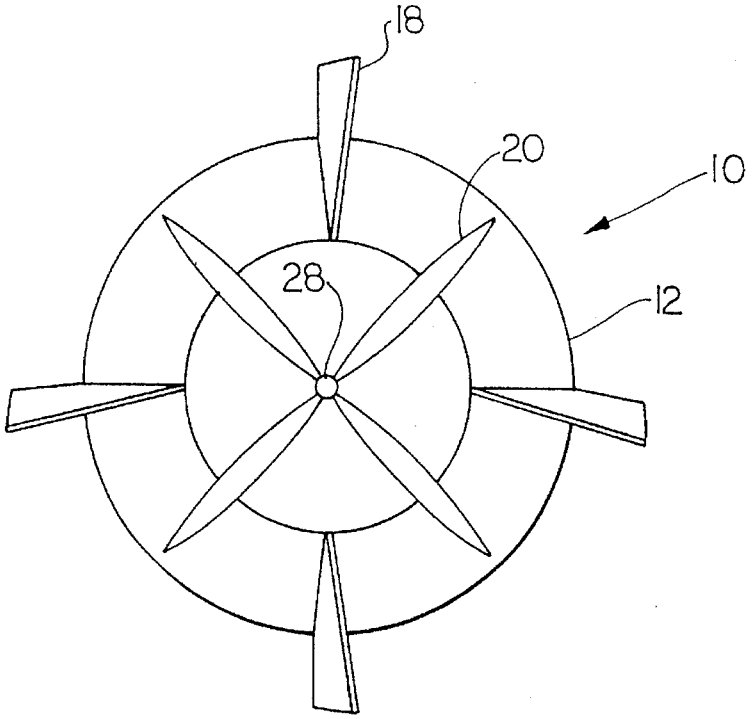
FIG. 4 is a diagrammatic end view, taken from the rear of the UAV.

Secured between the vehicle body 12 and the booster motor 14, is a pusher propeller 20 (FIG. 4) which is automatically deployed upon removal of the booster motor 14. The pusher propeller 20 is driven by a pusher motor 21 (FIG. 2) disposed within the vehicle body 12. The pusher motor preferably is a gasoline engine.

The booster motor 14 is typically discharged by a small explosive charge placed between the booster motor 14 and the body 12. The propeller 20 is spring loaded to automatically unfold and deploy when the booster 14 is discarded. The propeller 20 also can be configured as a tractor at the front of the body rather than as a pusher at the rear of the body; however, the pusher propeller configuration is preferred because when the booster motor 14 falls off, the propeller 12 can automatically deploy. There is a need for instrumentation in the forward part of the body 12, and a tractor configuration would be interfered with if the propeller is located up front. Instead of a pusher propeller, the UAV could also be powered by a low thrust, long burning rocket motor positioned inside the body.

Figure 3:
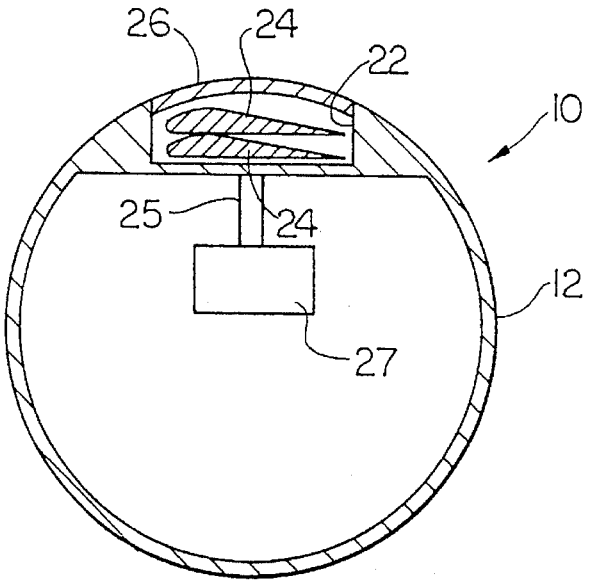
FIG. 3 is a diagrammatic sectional view, taken along line III—III of FIG. 1.

An elongated pocket 22 (FIG. 3) extends along a major portion of the length of the body 12 and has stored therein rotors 24. The rotors 24 are rotationally disposed on an extendible shaft 25. Shaft 25 is tilted at the necessary angle to provide lift upon rotation of rotors 24. The shaft 25 is joined to the body 12 and to an actuator 27 which extends the shaft 25 on receipt of a control signal from control circuitry (not shown) located within body 12. Prior to deployment, the pocket 22 is covered by a break-away cover 26 (FIGS. 1 and 3). Cover 26 breaks away when the shaft 25 and rotors 24 are extended by actuator 27. Cover 26 can also be an actuated cover that retracts within body 12.

The vehicle is provided with a "payload" compartment (not shown), wherein may be stored intelligence gathering equipment, such as cameras, and the like, and a fuel tank section for a fuel supply for the pusher motor 21.

Figure 5:
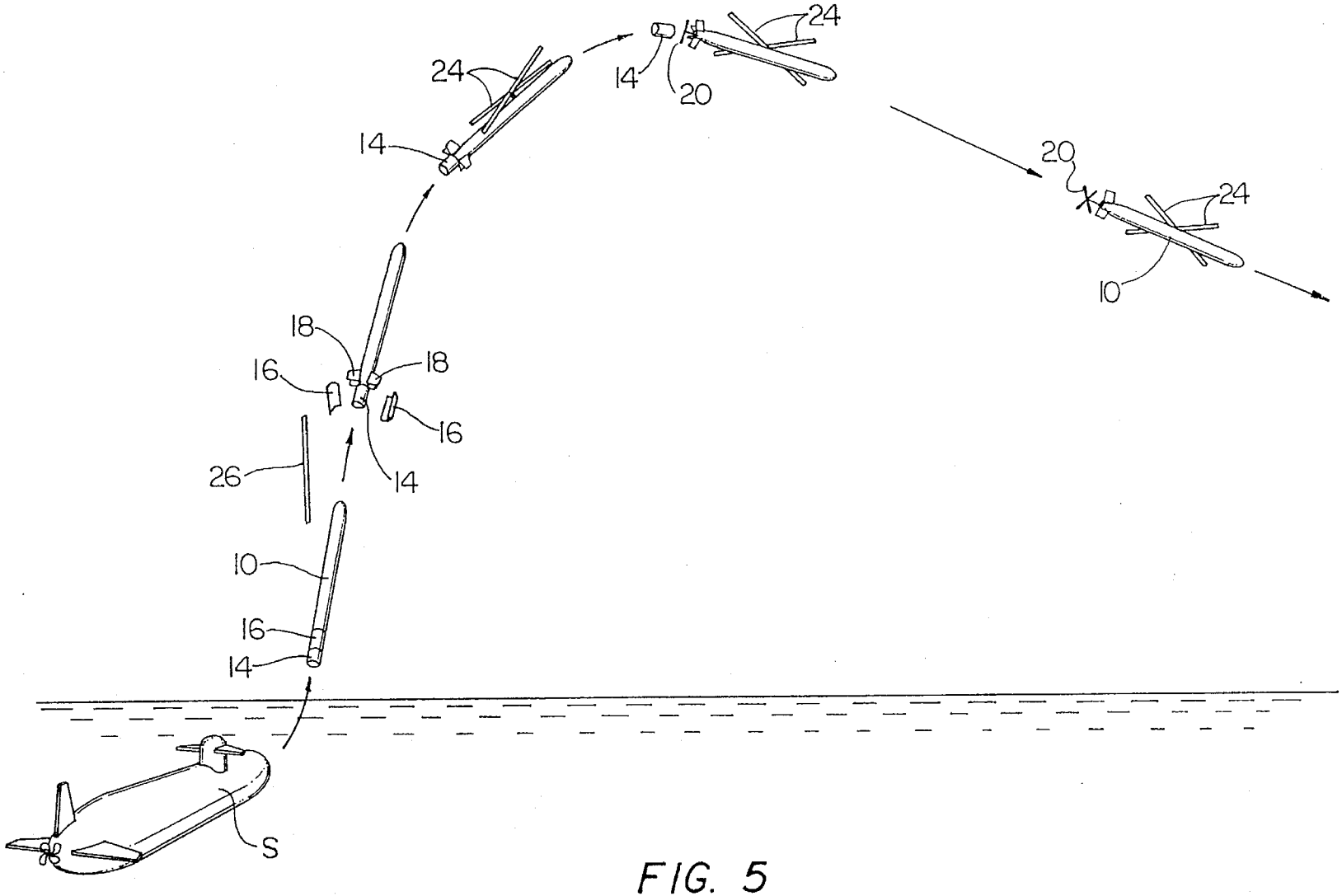
FIG. 5 is a diagrammatic depiction of the UAV in operation.
Figure 6:
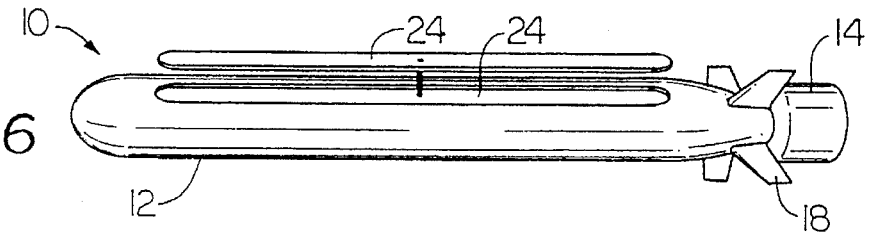
FIGS. 6–9 are perspective views of the UAV in a sequence of operational steps.
Figure 7:
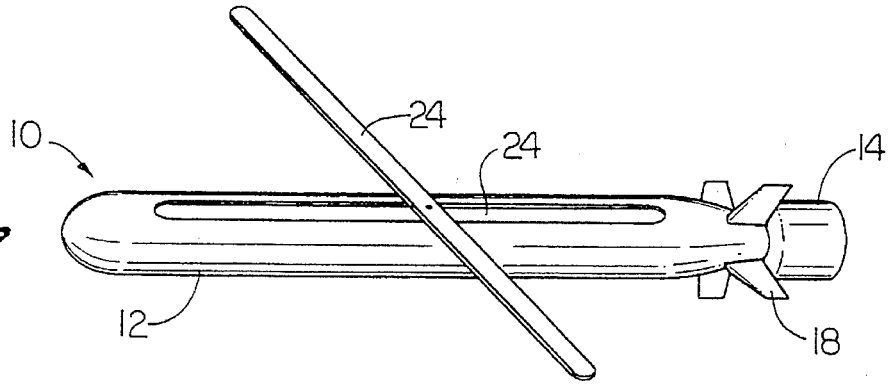

Referring to FIG. 5, it will be seen that in operation the vehicle 10 is launched from a submarine S, either from a torpedo tube or a vertical launch system. While the vehicle 10 is submerged, the booster motor 14 is automatically ignited and impels the vehicle into the air.

After water surface broach and gaining of altitude, the shroud 16 jettisons automatically, permitting deployment of the tail fins 18. Upon reaching a sufficient height, actuator 27 extends shaft 25. Rotors 24 and shaft 25 cause break away of cover 26, and rotors 24 emerge from vehicle pocket 22.

Figure 8:
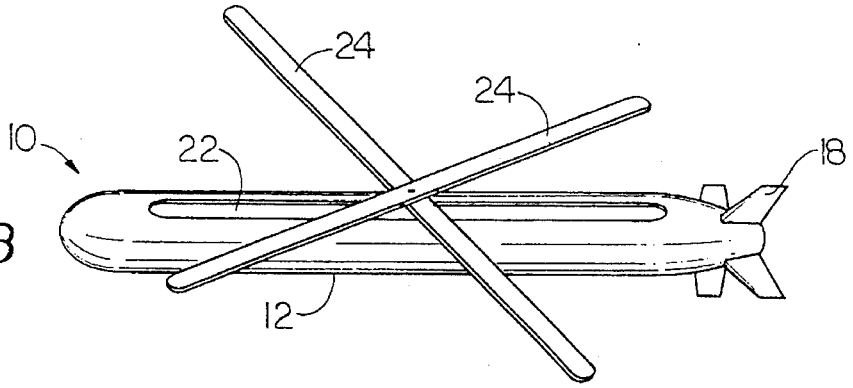
Figure 9:
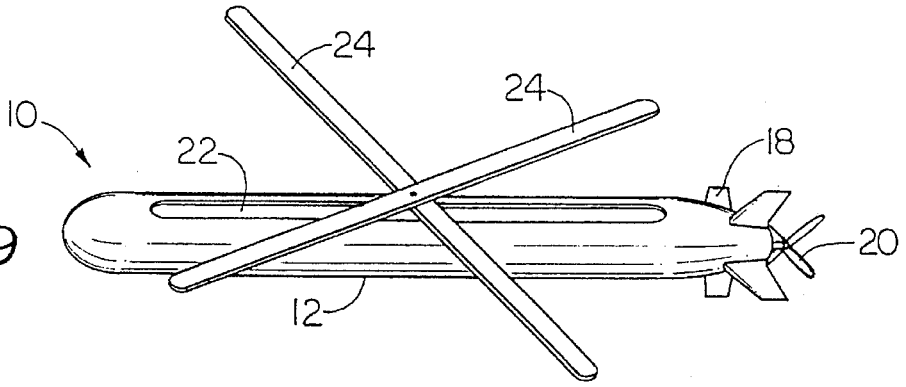

When the booster motor 14 burns out, the booster motor jettisons (FIG. 8) permitting a shaft 28 (FIG. 4) on which the pusher propeller 20 is mounted to move rearwardly and move the propeller 20 rearwardly for operation (FIG. 9). Upon rearward movement of the pusher propeller 20, the pusher motor 21 starts and drives the propeller 20 to provide thrust to the vehicle.

While the motor 21 and propeller 20 drive the vehicle forwardly, the forward motion of the vehicle causes rotation of the rotors 24. The rotors 24 have no independent drive means. Rotation of the rotors 24 provides lift for the vehicle. The vehicle therefore does not depend upon forward thrust alone to maintain altitude and can move at a slow speed. The vehicle moves at less than 150 knots and stays aloft for over four hours, during which time the intelligence gathering gear on board can operate.

The vehicle is handled using established Navy procedures and equipment for shipping and handling. A submarine need not undergo any modification to handle the vehicle. The launch and transition to flight are substantially the same as with the "Tomahawk" missile and therefore do not require extensive training programs prior to use. The vehicle, once airborne, can be controlled by existing communication capabilities in the submarine. A submarine is thereby enabled to independently deploy an intelligence gathering device, a capability currently lacking.

It is to be understood that the present invention is by no means limited to the particular construction herein disclosed and/or shown in the drawings, but also comprises any modifications or equivalents within the scope of the claims.

What is claimed is:

1. A submarine launched unmanned aerial vehicle, said vehicle comprising:

an elongated generally cylindrically-shaped body;

tail fins stored in said body and self-deployable to extend outwardly from said body;

a booster motor fixed to an aft end of said body and self-releasable from said body;

a propeller disposed between said booster motor and said aft end of said body and self-deployable upon loss of said booster motor to an exposed position at said aft end of said body;

a propulsion motor mounted in said body and operative to drive said propeller; and rotor means stored in said body and self-deployable to an exposed position wherein said rotor means provide lift to said vehicle.

2. The vehicle in accordance with claim 1 wherein said vehicle further comprises shroud means for covering said tail fins, said shroud means being self-releasable from said body to permit said tail fins to extend from their stored positions in said body to their outwardly-extended positions.

3. The vehicle in accordance with claim 2 wherein said body is of a size and configuration to be accepted by and launched from at least one of a submarine torpedo tube and a submarine vertical launch system.

4. The vehicle in accordance with claim 3 wherein said booster motor is a solid fuel motor.

5. The vehicle in accordance with claim 4 wherein said propulsion motor is adapted to self-start after burn out of said booster motor.

6. The vehicle in accordance with claim 3 wherein said rotor means are adapted to deploy after launch and water surface broach of said vehicle.

7. The vehicle in accordance with claim 3 wherein said shroud means is adapted to self-release from said body after launch and water surface broach of said vehicle.

8. A submarine launched unmanned aerial vehicle, said vehicle comprising:

a body having a forwared end, an aft end, an elongated generally cylindrical shape and a pocket formed in an upper surface thereof;

tail fins means stored in said body and self deployable to extend outwardly from said body, said tail fins having rotational actuators in said body to rotate said tail fins to aid in maneuvering said vehicle;

a booster motor fixed to said body aft end and self-releasable from said body;

a propeller disposed between said booster motor at said body aft end, said propeller being self-deployable to an exposed position at said body aft end upon release of said booster motor;

a propulsion motor mounted in said body and joined to drive said propeller;

a rotor means having rotor blades joined to a shaft stored in said body pocket, said rotor means being deployable to an exposed position wherein said rotor blades rotate and provide lift to said vehicle; and a rotor means actuator joined in said body to said rotor means for deploying said rotor means.

9. The vehicle in accordance with claim 8 further comprising a shroud means covering said tail fins prior to release of said booster motor, said shroud being self-releasable from said body to permit said tail fins to extend from their stored positions in said body to their outwardly-extended positions.

10. The vehicle in accordance with claim 8 further comprising a cover joined to said body and disposed over said pocket in said body prior to deployment of said rotor means.

11. The vehicle in accordance with claim 10 wherein said cover breaks away from said body means prior to deployment of said rotor means.

12. The vehicle in accordance with claim 8 further comprising control circuitry disposed in said body and joined to said tail fin means, said rotor means actuator and said propulsion motor.

* * * * *